US008112006B2

(12) United States Patent
Kasai

(10) Patent No.: US 8,112,006 B2
(45) Date of Patent: Feb. 7, 2012

(54) IMAGE FORMING APPARATUS AND METHOD FOR DISTINGUISHING SUITABLE PARTS IN THE SAME

(75) Inventor: Tadashi Kasai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 606 days.

(21) Appl. No.: 11/765,794

(22) Filed: Jun. 20, 2007

(65) Prior Publication Data

US 2007/0297814 A1 Dec. 27, 2007

(30) Foreign Application Priority Data

Jun. 21, 2006 (JP) ..... 2006-171881

(51) Int. Cl.
*G03G 15/00* (2006.01)

(52) U.S. Cl. ..... 399/12; 399/13; 399/24; 399/110

(58) Field of Classification Search ..... 399/8, 9, 399/12, 13, 24, 25, 110, 111; 347/19
See application file for complete search history.

(56) References Cited

U.S. PATENT DOCUMENTS 6,672,695 B1 * 1/2004 Naka et al. ..... 347/7
2004/0228641 A1 * 11/2004 Rommelmann et al. ..... 399/12
2005/0254841 A1 * 11/2005 Tomitaka ..... 399/12

FOREIGN PATENT DOCUMENTS

JP 10-069139 A 3/1998
JP 2000-284581 10/2000
JP 2005-326732 A 11/2005

* cited by examiner

*Primary Examiner* — Benjamin Schmitt
(74) *Attorney, Agent, or Firm* — Rabin & Berdo, P.C.

(57) ABSTRACT

An image forming apparatus that can provide notification, so that maintenance personnel of a manufacturer or the like can be made aware of a usage condition in a case where an unsuitable toner cartridge is intermittently used. The image forming apparatus is equipped with a primary storage section storing specific information concerning a replaceable part, such as a toner cartridge that can be attached or removed from a main body, and a secondary storage section storing information concerning usage of the replaceable part. The specific information is read from the primary storage section in a condition where the replaceable part is attached, and a judgment is made by a judgment section concerning whether the replaceable part is suitable. If the replaceable part cannot be judged as suitable, information concerning the use of the replaceable part is stored in the secondary storage section and notification is provided by a notification section.

16 Claims, 21 Drawing Sheets

IMAGE FORMING APPARATUS AND METHOD FOR DISTINGUISHING SUITABLE PARTS IN THE SAME

BACKGROUND OF THE INVENTION

1. Field of the Invention

The present invention relates to an image forming apparatus containing attachable and removable replaceable parts such as a toner cartridge or the like.

2. Description of Related Art

Conventionally, it is common for an electrophotographic image forming apparatus such as a copy machine, fax machine, or printer, to contain multiple development devices that each accommodate developers including prescribed toners and are disposed facing image holding bodies to make visible latent images formed on the image holding bodies. A toner supply vessel, such as a toner cartridge or toner bottle, is equipped externally to a toner supply unit of the development device at a time of maintenance for supplying the toner, for example.

In such a conventional image forming apparatus, to extract a counterfeit toner cartridge, two-way communication is executed between a communication unit on the side of the toner cartridge and a communication unit on the side of the apparatus main body. A judgment is then made as to whether the information concerning the toner cartridge received from the communication unit on the side of the toner cartridge indicates that the toner cartridge is suitable with the apparatus. In a case where the judgment is that the equipped toner cartridge is unsuitable, irregular image formation conditions, such as increased electrostatic potential, increased toner consumption due to a decreased amount of light for exposure, and a worsening of fusion ability due to a decrease in a fusion temperature, for example, are known to arise because of the extraction of counterfeit material from the unsuitable toner cartridge (see Japanese Patent Application Publication No. 2000-284581).

In the image forming apparatus with the conventional structure described above, however, because the maintenance personnel of the manufacturer or the like is not aware of the continual usage of the unsuitable toner cartridge even where the apparatus is damaged through the continual use of the unsuitable toner cartridge, there is a problem that the damage cannot easily be prevented and the use of the unsuitable toner cartridge cannot be sufficiently restricted.

SUMMARY OF THE INVENTION

It is an objective of the present invention, in consideration of the technical problems described above, to provide an image forming apparatus that enables a maintenance personnel of the manufacturer or the like to be aware of the usage condition even where the unsuitable toner cartridge is continuously used and that restricts the use of the unsuitable toner cartridge by informing a user of the usage condition as described above, and to further provide a method for distinguishing the suitable parts in the aforementioned image forming apparatus.

In consideration of the technical problems described above, the image forming apparatus of the present invention contains a replaceable part attachable or removable from a main body, a primary storage section attached to the replaceable part for storing specific information concerning the replaceable part, a reading unit for reading the specific information from the primary storage section in a condition where the replaceable part is attached, a judgment unit for making a judgment as to whether the replaceable part is suitable based on the specific information read from the reading unit, a secondary storage section for storing information concerning use of the replaceable part in a case where a judgment result of the judgment unit is that the replaceable part is unsuitable, and a notification unit for providing notification based on information concerning use of the replaceable part read from the secondary storage section.

Furthermore, a method for distinguishing a suitable part contains the steps of equipping on a portion of a replaceable part attachable and detachable from a main body of an apparatus, a primary storage section for storing specific information concerning the replaceable part, reading the specific information from the primary storage section in a condition where the replaceable part is equipped, storing information concerning usage of the replaceable part in a secondary storage section in a case where a judgment is made that the replaceable part is unsuitable as a result of a judgment as to whether the replaceable part is suitable based on the read specific information, reading the information concerning the usage of the replaceable part from the secondary storage section, and providing notification based on the information concerning usage.

Through the present invention, a judgment is made as to whether the replaceable part is suitable based on the specific information read from the primary storage section. In a case where the replaceable part is unsuitable, the information concerning usage of the replaceable part is further stored in the secondary storage section. Therefore, in a case where maintenance personnel or the like comes to perform maintenance of the image forming apparatus, the maintenance personal is aware of the information concerning the usage from the secondary storage area and can therefore restrict the use of the unsuitable replaceable part.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DESCRIPTION OF PREFERRED EMBODIMENTS

Preferred embodiments of the present invention will be described hereinafter with reference to drawings.

First Embodiment

Figure 1:
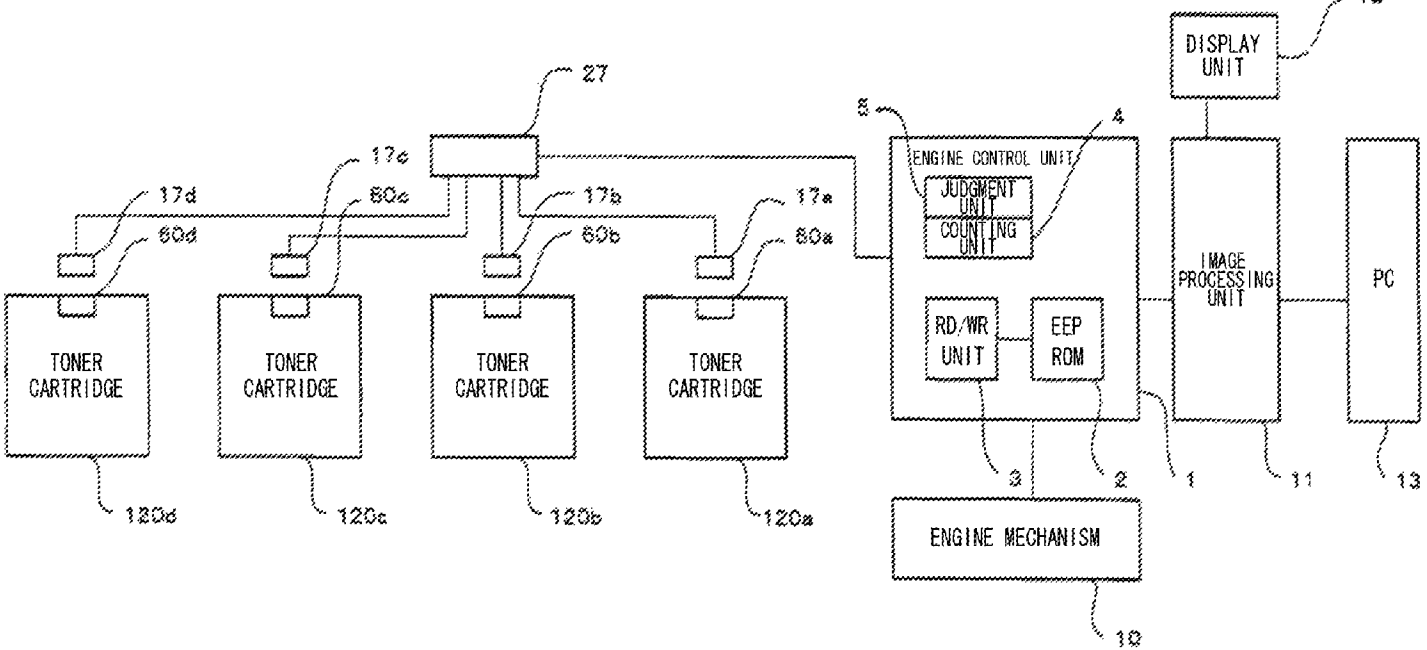
FIG. 1 is a block diagram showing an overall structure of an image forming apparatus according to a first embodiment of the present invention.

FIG. 1 is an overall block diagram of a first embodiment of the image forming apparatus according to the present invention, and is a diagram of a case where the image forming apparatus according to the embodiment is an electrophotographic color printing apparatus. In the image forming apparatus of the present embodiment, four toner cartridges 120*a*, 120*b*, 120*c*, 120*d* are disposed corresponding to four colors and each toner cartridge 120*a*, 120*b*, 120*c*, 120*d* houses a wireless tag (RFID). A wireless tag 60*a* is housed in an upper surface of the toner cartridge 120*a* and is composed of a tag chip housing nonvolatile memory and a substrate mounted with the tag chip, having an antenna pattern. Specific information concerning the toner cartridge or the like is stored in the nonvolatile memory, which serves as a primary memory section. The specific information is an ID code (8 byte) assigned at a time when the wireless tag (RFID) is created. A communication antenna 17*a* is affixed at a location inside the printing apparatus facing the wireless tag 60*a*, generates an alternating magnetic field for supplying power to the wireless tag 60*a*, and transmits a wireless signal. Wireless tags 60*b*, 60*c*, 60*d* have the same structure, are housed in an upper surface of toner cartridges 120*b*, 120*c*, 120*d* respectively, and are disposed to face communication antennae 17*b*, 17*c*, 17*d* respectively.

A reader/writer unit 27 is a device providing the signal and voltage to the communication antennae 17*a*, 17*b*, 17*c*, 17*d* and connected thereto via cables, respectively, thereby executing reading and writing of the wireless tags. The toner cartridges 120*a*, 120*b*, 120*c*, 120*d* can each be attached and detached from image forming units, not shown. Each of the toner cartridges 120*a*, 120*b*, 120*c*, 120*d* can be formed as a single body with the image forming unit, or the image forming units may be attachable and detachable from the main body. The toner cartridges 120*a*, 120*b*, 120*c*, 120*d* are each filled with different color toner to execute color printing in four colors.

An engine control unit 1 controls a mechanism by inputting a sensor signal for detecting a condition and outputting a control signal for driving an engine mechanism 10 made up of, for example, mechanical parts for supplying, feeding, and ejecting a recording medium. Furthermore, the engine control unit 1 controls the reader/writer unit 27, using a control command or the like, to execute writing to and reading from the wireless tags 60*a*, 60*b*, 60*c*, 60*d*. Upon receiving printing data from an image processing unit 11, the engine control unit 1 outputs the printing data to an exposure unit, not shown, of the engine mechanism 10 to execute printing. An EEPROM 2 storing usage information of the toner cartridges 120*a*, 120*b*, 120*c*, 120*d* is loaded inside the engine control unit 1. An RD/WR unit 3 executes writing to and reading from the EEPROM 2. A counting unit 4 counts the number of dots of each color in the printing data of every page, calculates the amount of toner consumed, and also counts the number of pages. A judgment unit 5 makes a judgment as to whether a replacement part is suitable based on the read specific information and makes a judgment as to whether the read specific information indicates that the replacement part is suitable by accessing the wireless tags 60*a*, 60*b*, 60*c*, 60*d* via the reader/writer unit 27.

The engine mechanism 10 executes supply, feeding, and ejection of the recording medium by receiving input from various sensors and executing driving of an actuator of motors such as a motor for driving a drum, a motor for feeding paper, or the like. Furthermore, other units such as an exposure unit, fusion unit, high pressure control unit, and power source compose the engine mechanism 10. The details are explained referencing FIG. 4, described later. The image processing unit 11 receives a print command from a PC 13, serving as a host device, via a host I/F to output the printing data to the engine control unit 1 executing image processing. Furthermore, the image processing unit 11 controls the overall apparatus by sending the control command to the engine control unit 1 and receiving status information from the engine control unit 1. The image processing unit 11 outputs display data to a display unit 12. The display unit 12 inputs the display data from the image processing unit 11 along with the control command to execute the display. The display unit 12 has an operation switch and outputs the condition to the image processing unit 11.

Figure 3:
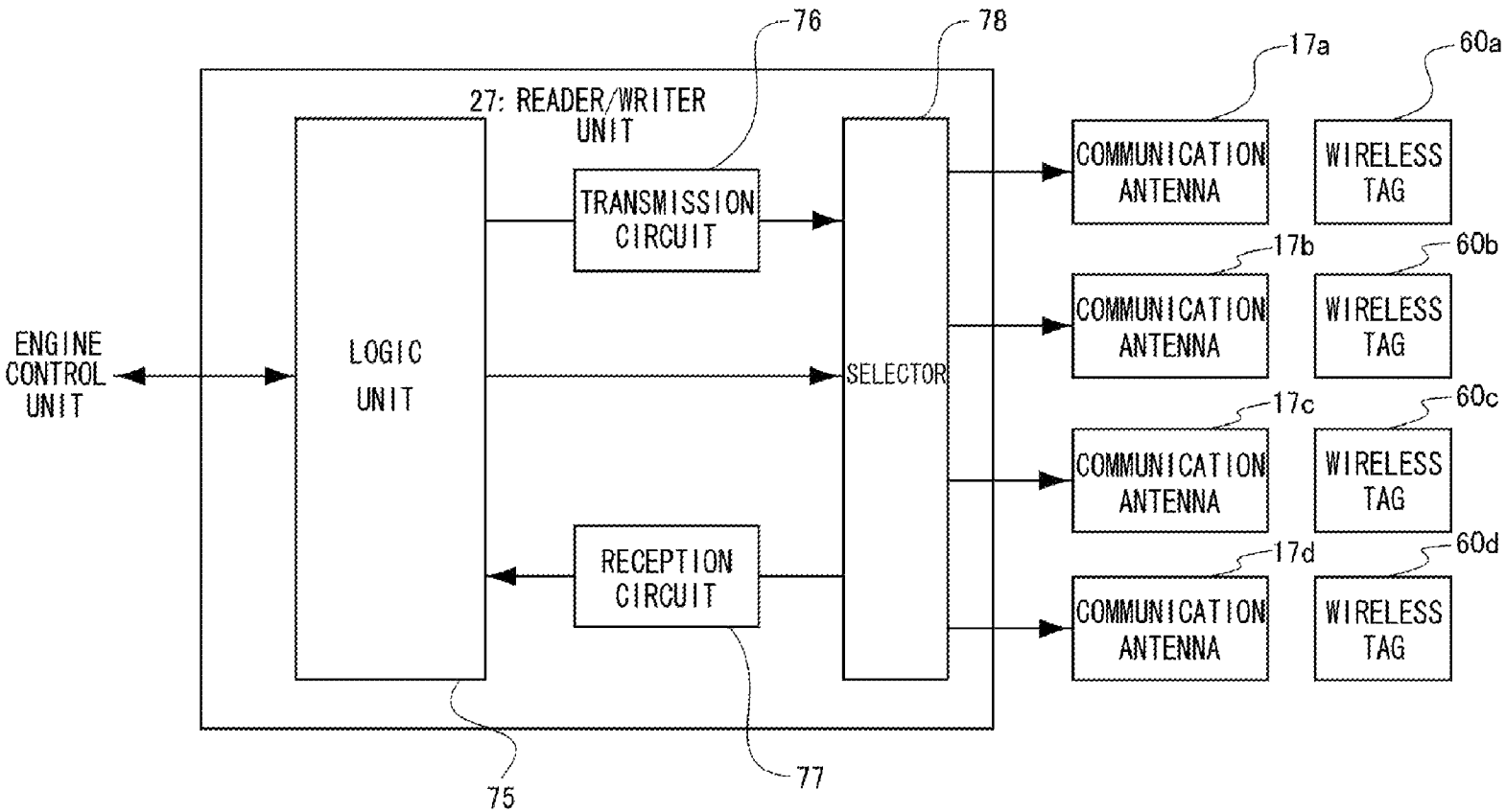
FIG. 3 is a block diagram showing an internal structure and surrounding area of a reader/writer of the image forming apparatus according to the first embodiment of the present invention.

Next is a description of the structure of the reader/writer unit and the wireless tag. FIG. 3 is a block diagram of the reader/writer unit, which is formed of a logic unit 75, a transmission circuit 76, a reception circuit 77, and a selector 78. The logic unit 75 is connected to the engine control unit 1 by a serial I/F and is driven by an order from the engine control unit 1. Furthermore, the logic unit 75 sends a reply concerning the status to the engine control unit 1. The logic unit 75 internally includes a transmission buffer, a reception buffer, and a control unit for controlling the two buffers. The transmission circuit 76 is made up of an ASK modulation circuit, a filter, and the like. The reception circuit 77 is made up of an amp, a filter, a level converting circuit and the like. The selector 78 is a circuit for selecting and switching to one of four antenna connections. The communication antennae 17*a*, 17*b*, 17*c*, 17*d* are connected to the tip of the selector and a loop pattern is formed on each communication antenna to function as an antenna. The data sent from the engine control unit 1 is stored in the transmission buffer inside the logic unit. The data is then ASK-modulated in the transmission circuit 76 and communicated to the wireless tag via the communication antenna selected by the selector 78. In a case where the data is read from the wireless tag, the data is communicated to the wireless tag via the communication antenna selected by the selector 78 and is then stored in the reception buffer inside the logic unit 75 after being demodulated and converted into a logic signal by the reception circuit 77. The engine control unit 1 then reads the content of the buffer.

Figure 2:
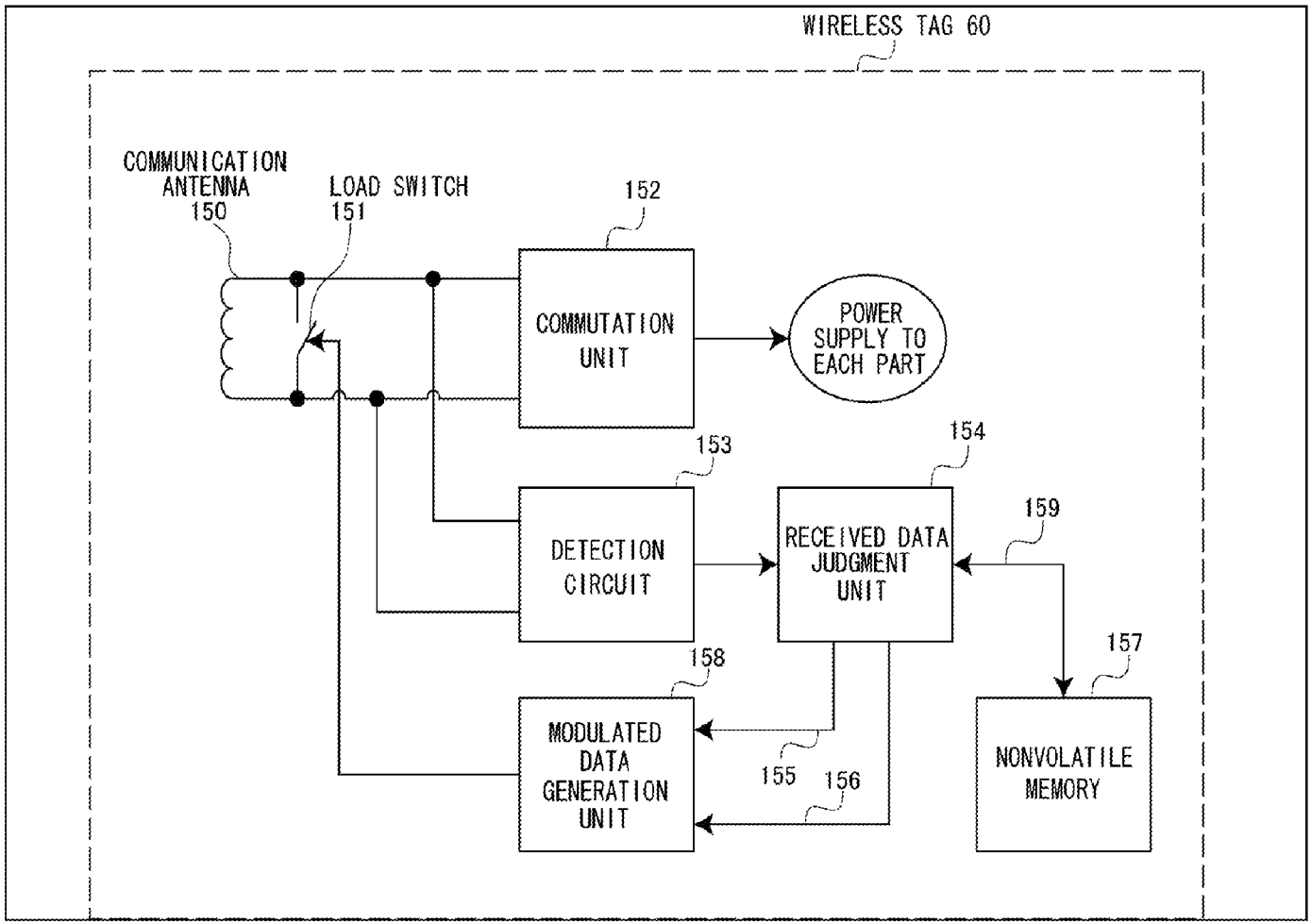
FIG. 2 is a block diagram showing an internal structure of a wireless tag of the image forming apparatus according to the first embodiment of the present invention.

FIG. 2 is a block diagram showing the internal structure of the wireless tags 60*a*, 60*b*, 60*c*, 60*d*. A load switch 151, a commutation unit 152, a detection circuit 153, and a modulated data generation unit 158 are connected to both ends of a communication antenna 150. The communication antenna 150 receives the ASK-modulated data using current generated through an alternating magnetic field output by the communication antennae 17*a*, 17*b*, 17*c*, 17*d*. The commutation unit 152 supplies power to the wireless tags 60*a*, 60*b*, 60*c*, 60*d* by commutating the alternating current generated at the communication antenna 150 through the alternating magnetic field output by the communication antennae 17*a*, 17*b*, 17*c*, 17*d*. The detection circuit 153 demodulates into a binary signal the received data ASK-modulated according to the alternating magnetic field and then outputs the data to a received data judgment unit 154. The received data judgment unit 154 extracts the received data from the received demodulated data, decodes a received data command, detects a carrier signal, and outputs a response code 156 corresponding to the received data command and a carrier detection signal 155 to the modulated data generation unit 158. In a case where the decoded result of the received data command indicates reading or writing of the memory, the received data judgment unit 154 accesses the nonvolatile memory 157 using a nonvolatile memory access signal 159. The nonvolatile memory 157 executes reading or writing of the data from the memory according to the command of the input nonvolatile memory access signal 159. The result of the reading (the read data) or writing is output to the received data judgment unit 154 using the same nonvolatile memory access signal 159. Through the input of the carrier detection signal 155, the modulated data generation unit 158 sends the data by switching the load switch 151 on or off according to the response code 156 corresponding to the received data command, input in the same manner.

Figure 4:
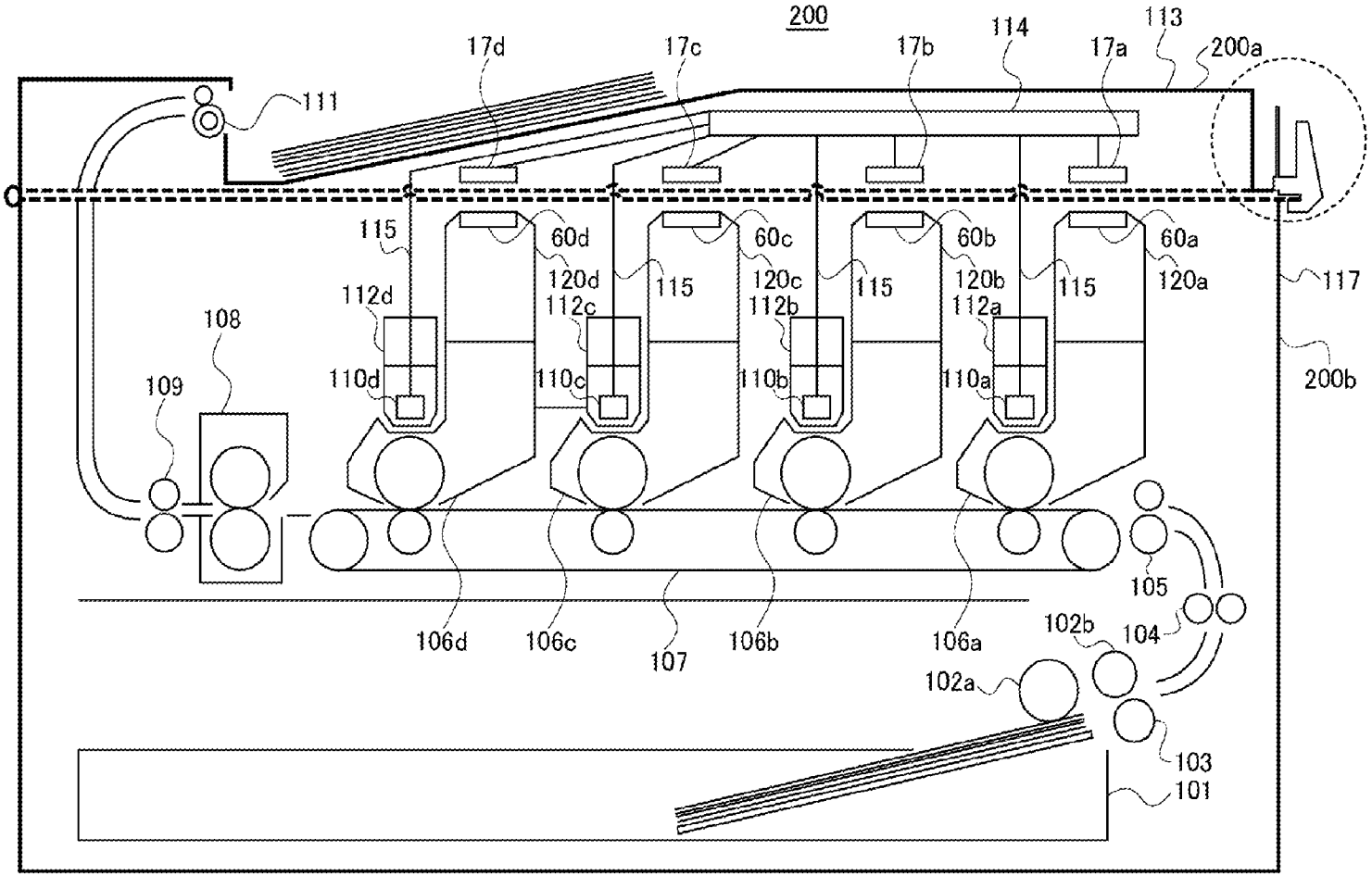
FIG. 4 is a pattern diagram showing an overview of a general structure of the image forming apparatus according to the first embodiment of the present invention.

FIG. 4 is a diagram showing a structural overview of a case where the image forming apparatus is an electrophotographic color printing apparatus 200. A mechanism for color printing is disposed inside a main chassis storing the parts making up the body of the apparatus, and the toner cartridges 120*a*, 120*b*, 120*c*, 120*d*, which are replaced since the amount of toner is reduced through toner consumption, are affixed to the body of the apparatus in an attachable and detachable manner. The color printing apparatus 200 contains a paper cassette 101 in a lower portion for containing the recording medium. The printing apparatus 200 sends the recording medium to a feeding roller 104 in an upper portion using a paper supply rollers 102*a*, 102*b*, and a separation roller 103 inside a paper supply mechanism, not shown, for separating and supplying the recording media sheet by sheet from the paper cassette 101. The recording medium is sent from the feeding roller 104 to arrive at the feeding roller 105, and is then sent by the feeding roller 105 to a transfer belt 107, which is a stage on which the image is formed by multiple image forming units 106. The multicolored image formed sequentially by each of the multiple image forming units 106*a*, 106*b*, 106*c*, and 106*d* is transferred onto the recording medium fed by the transfer belt 107, and the recording medium on which the image is formed is then sent to a fusion device 108. The multicolored image transferred onto the recording medium is fused by the fusion device 108. The recording medium onto which the image is fused is sent to a feeding roller 109, and is further fed to a delivery tray 113 on an upper surface of the apparatus by a feeding roller 111 disposed below the feeding roller 109.

LED units 110*a*, 110*b*, 110*c*, 110*d* form the latent image on each of the image formation units 106*a*, 106*b*, 106*c*, 106*d*, which correspond to these LED units, respectively. The LED units 110*a*, 110*b*, 110*c*, 110*d* are located and held to contact the corresponding image formation units 106*a*, 106*b*, 106*c*, 106*d* by corresponding holders 112*a*, 112*b*, 112*c*, 112*d*. Each of the holders 112*a*, 112*b*, 112*c*, 112*d* is secured to an upper frame 113 that can be opened and closed. Accordingly, the LED units 110*a*, 110*b*, 110*c*, 110*d* can be moved by the opening and closing of the upper frame 113. The LED units 110*a*, 110*b*, 110*c*, 110*d* are connected to a control unit 114 inside the image forming apparatus 200 by signal cables 115. The toner cartridges 120*a*, 120*b*, 120*c*, 120*d*, which are replaceable parts in the present embodiment, are equipped on the image formation units 106*a*, 106*b*, 106*c*, 106*d* to supply toner, respectively. The wireless tags 60*a*, 60*b*, 60*c*, 60*d* for conducting two-way communication without contact are incorporated in upper portions of the toner cartridges 120*a*, 120*b*, 120*c*, 120*d*, respectively. The communication antennae 17*a*, 17*b*, 17*c*, 17*d* are affixed to the upper frame 113 in a manner to face the wireless tags, respectively. The control unit 114 includes the reader/writer unit 27, the engine control unit 1, the image processing unit 11, and the display unit 12 of FIG. 1, and is equipped at an arbitrary place inside the apparatus via a cable, not shown.

Figure 5:
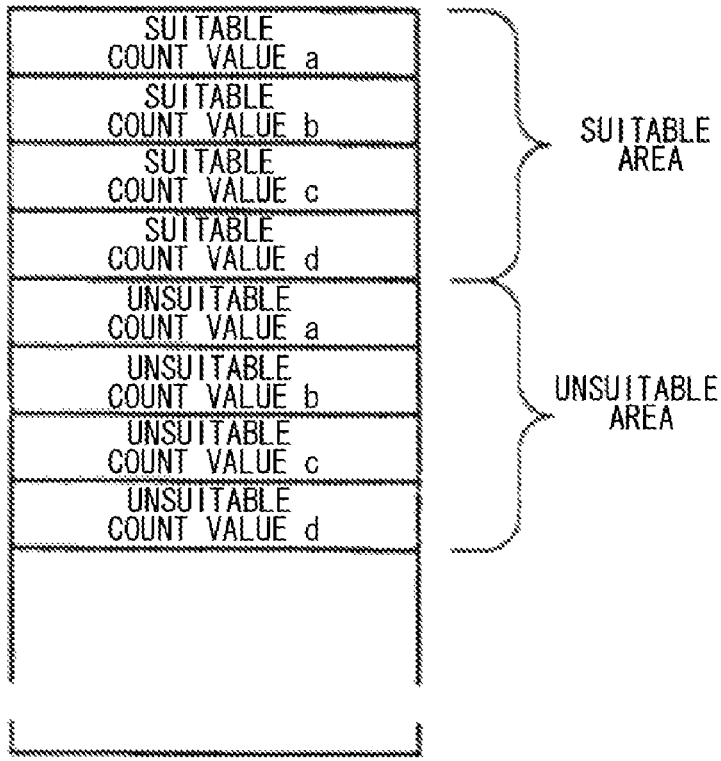
FIG. 5 is a memory map showing one example of data stored in an EEPROM of the image forming apparatus according to the first embodiment of the present invention.
Figure 6:
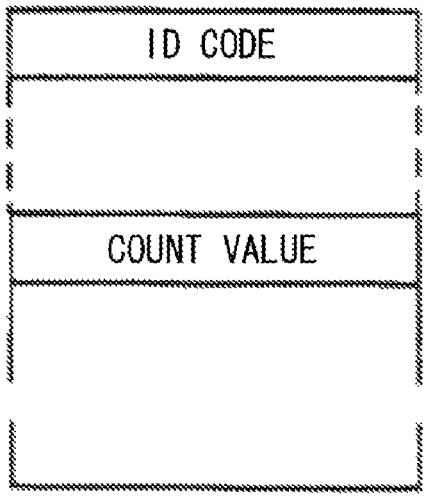
FIG. 6 is a memory map showing one example of data stored in a memory inside the wireless tag of the image forming apparatus according to the first embodiment of the present invention.

On the side of the main body, as explained above, the EEPROM 2 serving as a secondary memory section is equipped on a portion of the engine control unit 1. FIG. 5 is one example of the data stored in the EEPROM 2. The values counted by the counting unit 4 are divided into suitable and unsuitable values, which are stored by the RD/WR unit 3 in a different area for each color. In a case where the wireless tag 60*a* is judged to be suitable by the judgment unit 5 via the reader/writer unit 27, the count value corresponding to toner cartridge 120*a* is stored as Suitable Count value a in the suitable area. On the other hand, in a case where the wireless tag 60*a* is judged to be unsuitable by the judgment unit 5, the count value corresponding to toner cartridge 120*a* is stored as Unsuitable Count value a in the unsuitable area. In the same manner, the count values for each of the other wireless tags 60*b*, 60*c*, 60*d* are stored in the suitable area or unsuitable area. FIG. 6 shows one example of the data stored in the memory of the wireless tags. The count value and the ID code (8 bytes, for example) assigned during creation of the RFID are stored in the wireless tags.

Figure 7:
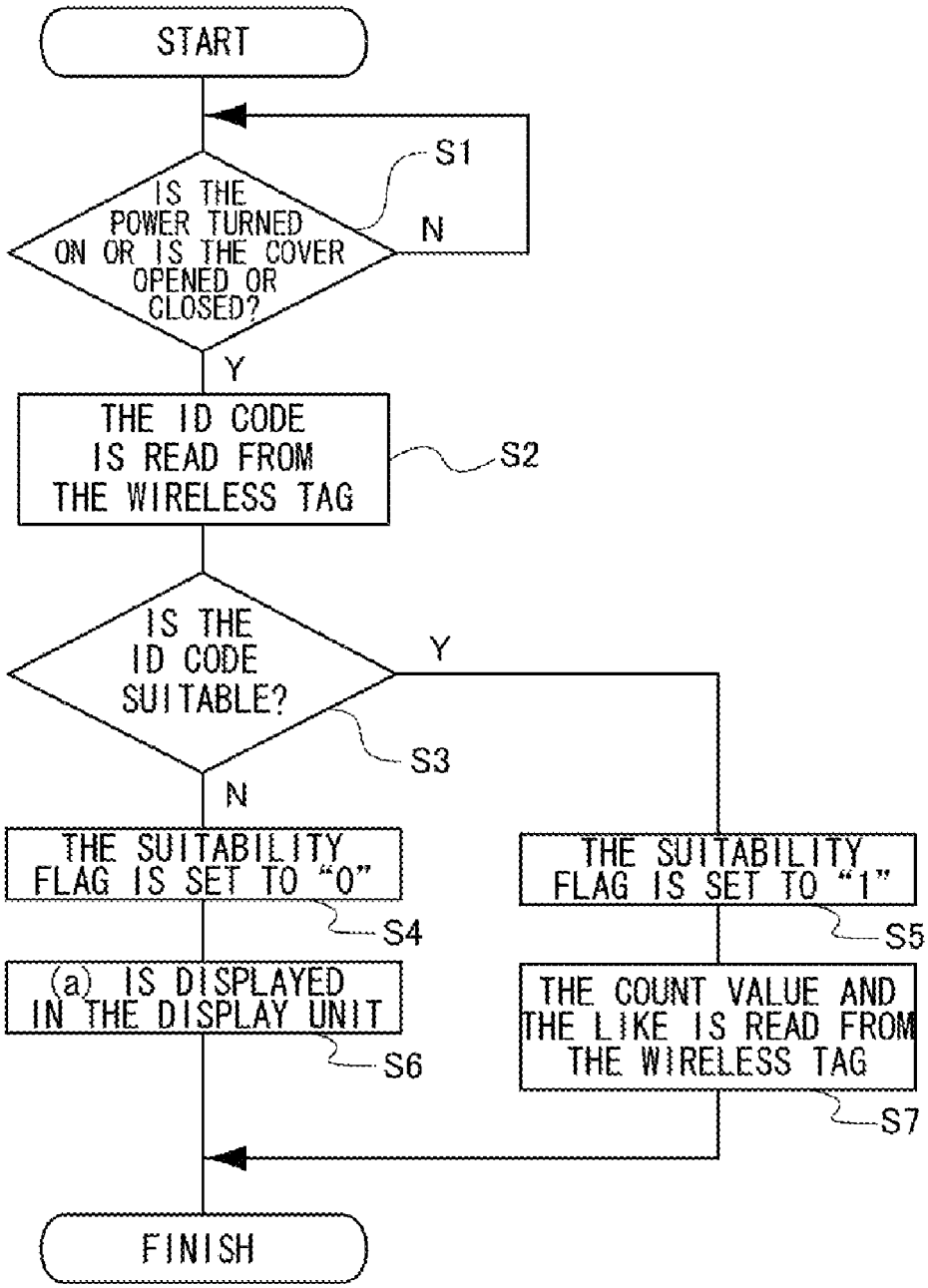
FIG. 7 is a flow chart showing a performance of a judgment unit of the image forming apparatus according to the first embodiment of the present invention.
Figure 10:
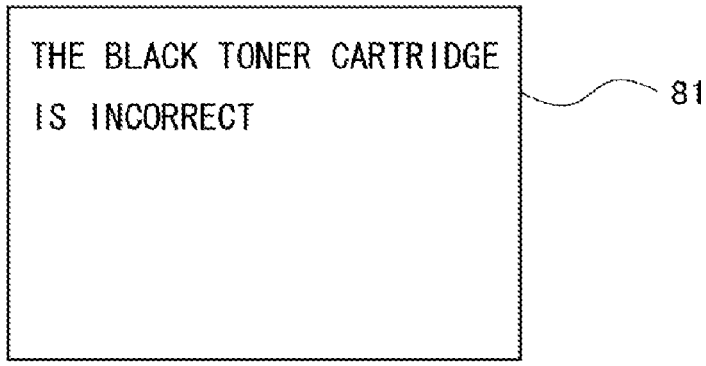
FIG. 10 is a pattern diagram showing an example display of the display unit of the image forming apparatus according to the first embodiment of the present invention.

FIG. 7 is a flow chart showing the performance of the judgment unit 5. The process is explained only in terms of the wireless tag 60*a* to minimize the necessary explanation, but the same process is executed for the wireless tags 60*b*, 60*c*, 60*d*. First, in a case where the power is turned on or a cover 200*a* is opened or closed at step S1, the process moves to step S2. In a case where the power is not turned on and the cover 200*a* is not opened or closed, the process remains at step S1. At step S2, the ID code, which is the specific information of the printer cartridge, is read from the wireless tag 60*a* via the reader/writer unit 27. At step S3, if the read ID code is identical to the previously stored ID code, the wireless tag is suitable and the process moves to step S5, but if the two codes are not identical, the wireless tag is unsuitable and the process moves to step S4. At step S5, a suitability flag is set to "1" to indicate suitability. Next, at step S7, the information such as the count value is read from the wireless tag 60*a* via the reader writer unit 27 and the process is finished. At step S4 where the two codes are not identical, the suitability flag is set to "0" to indicate unsuitability. Next, at step S6, a command is sent via the image processing unit 11 to display the screen 81 of FIG. 10 on the display unit 12 and the process is finished. For example, the phrase "The black toner cartridge is incorrect" can be displayed in the screen 81 to inform the user of unsuitability. In a case where a judgment is made that the different wireless tag 60*b* is unsuitable, a process is executed to notify the user concerning a different color, for example, "The cyan toner cartridge is incorrect".

Figure 8:
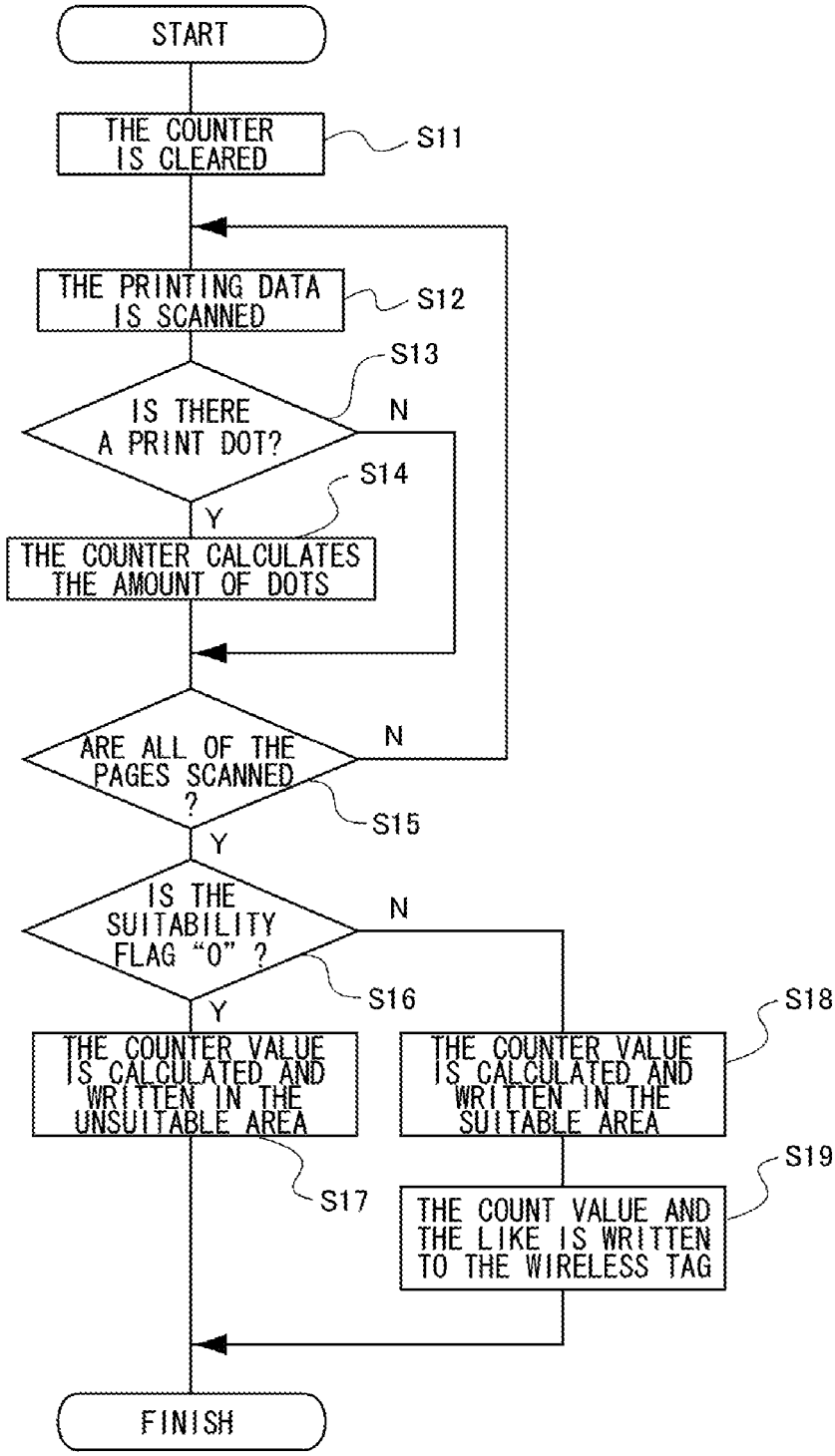
FIG. 8 is a flow chart showing a performance of a counting unit of the image forming apparatus according to the first embodiment of the present invention.

FIG. 8 is a flow chart showing the performance of the counting unit 4. First, at step S11, a counter inside the counting unit 4 is cleared. The printing data is then scanned at step S12, and a judgment is made at step S13 as to whether there is a printing dot in the scanned area. If there is a printing dot, the process moves to step S14. If there is not a printing dot, the process moves to step S15. At step S14, the amount of dots is added to the counter and the process moves to step S15. At step S15, a judgment is made as to whether all of the pages are scanned. In a case where all of the pages are scanned, the process moves to step S16, and in a case where all of the pages have not been scanned, the process returns to step S12, so that the printing dots of all of the pages are calculated. At step S16, a judgment is made as to whether the suitability flag described with reference to FIG. 7 is set to "0". If the suitability flag is "0", the process moves to step S17. If the suitability flag is "1", the process moves to step S18. At step S17, the count value is added to Unsuitable Count value a in the unsuitable area and written therein and the process is finished. At step S18, the count value is added to Suitable Count value a in the suitable area and written therein, and the process is finished. Next, the count value written at step S18 is written to the wireless tag 60*a* via the reader/writer unit 27. The process of adding the count values for the wireless tags 60*b*, 60*c*, 60*d* is executed in the same manner.

In a case where a judgment is made that the wireless tag is unsuitable in the manner described above, the count value is stored as the number of dots corresponding to the consumed toner in the unsuitable area in the EEPROM of the main body. The count value of the stored data can be confirmed by maintenance personnel through a confirmation method according to the printing or display unit by a user address. In a case where the image forming apparatus contains the function of a fax machine, an apparatus is known having a function whereby the online status of the apparatus is automatically checked and the maintenance information is sent. The apparatus having this function may have a structure whereby the maintenance station is automatically informed, or may have a structure whereby the image forming apparatus sends an e-mail to the maintenance station.

Figure 9:
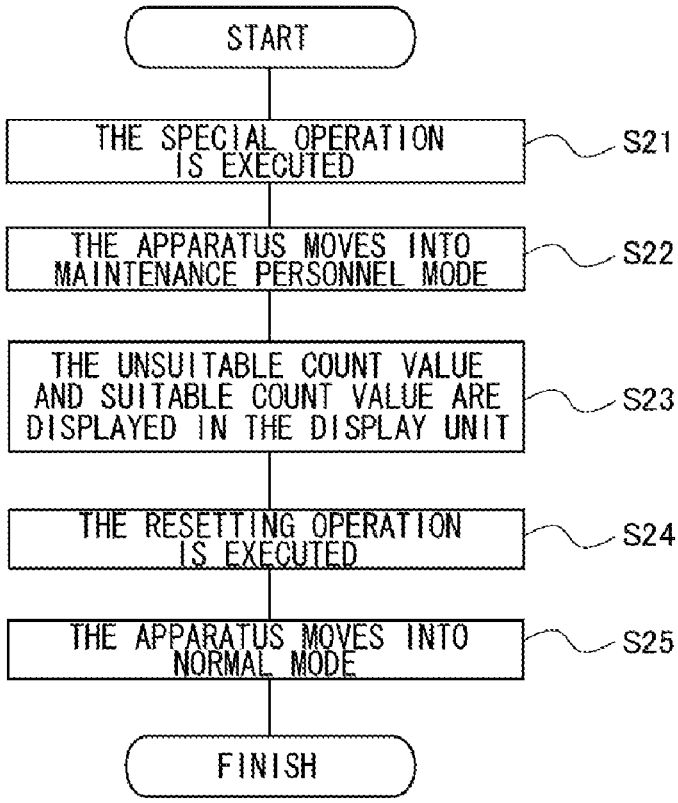
FIG. 9 is a flow chart showing a performance of a display unit of the image forming apparatus according to the first embodiment of the present invention.

FIG. 9 is a flow chart showing the operation of the display unit. First, at step S21, the user executes an arbitrary special operation with abnormal use through the display unit, so that the apparatus enters into a maintenance personnel mode (step S22). This condition assumes a special operation required by the maintenance personnel. A case where the special operation involves simultaneously pressing multiple input keys for a prescribed amount of time (for example, five seconds) is given as an example. Upon entering into maintenance personnel mode, the unsuitable count value and suitable count value are displayed on the display unit (step S23). Depending on the restrictions of the display unit, the display may be the count value or may be in terms of pages or the amount of toner consumed. Next, a resetting operation is executed through an arbitrary key operation (step S24), and the apparatus returns to the normal mode (step S25). At step S23, the unsuitable count value and suitable count value are displayed on the display unit, but the unsuitable count value and suitable count value may also be printed out in the maintenance personnel mode.

According to the first embodiment descried above, in a case where a judgment is made that the wireless tag is unsuitable, the count value is stored as the number of dots corresponding to the consumed toner in the unsuitable area in the EEPROM of the main body, and the count value of the stored data can be confirmed by maintenance personnel through a confirmation method according to the printing or display unit by a user address. Therefore, the expected result is that the use of the unsuitable toner cartridge can be restricted because the user can understand the condition of intermittent usage of the unsuitable toner cartridge.

Second Embodiment

Figure 11:
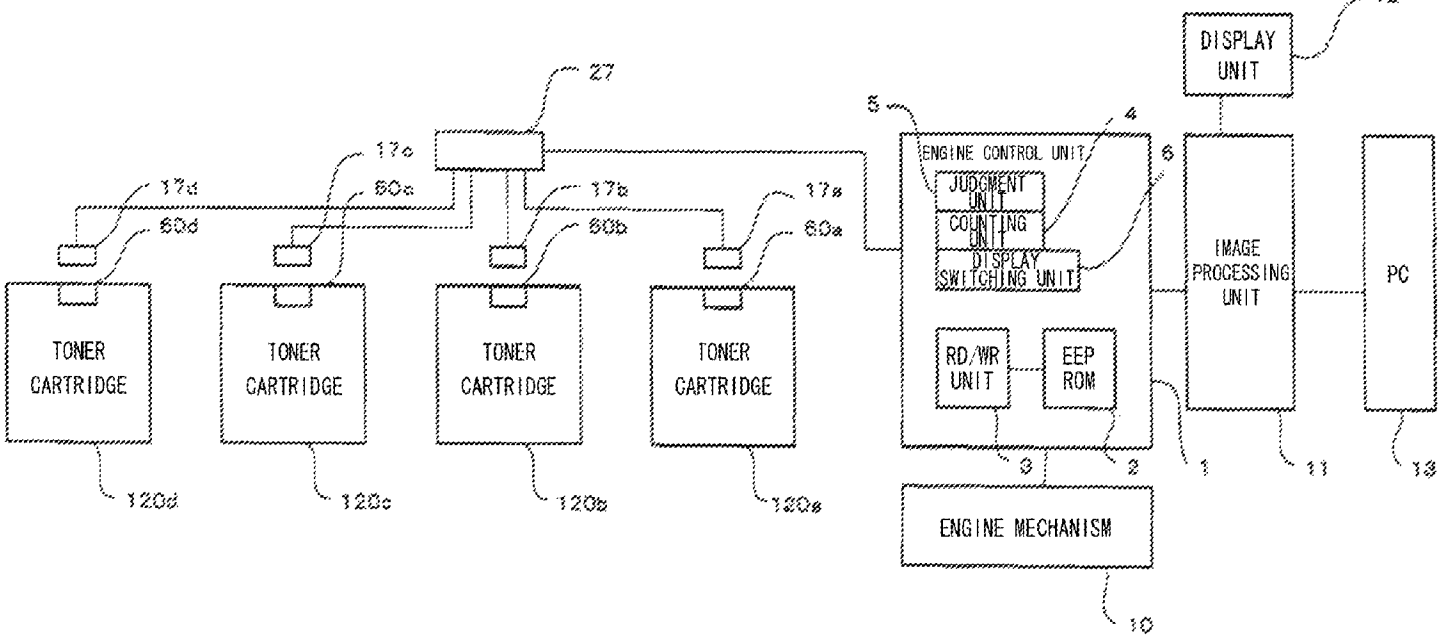
FIG. 11 is a block diagram showing an overall structure of an image forming apparatus according to a second embodiment of the present invention.

FIG. 11 is an overall block diagram of the color printing apparatus of the first embodiment. The difference between the apparatus of FIG. 11 and the color printing apparatus of the first embodiment shown in FIG. 1 is that a display switching unit 6 is added to the engine control unit 1. The display switching unit 6 has a function to read the value of the suitability flag and the unsuitability count value and switch the content in the display unit 12 via the image processing unit 11 based on the size of the value.

Figure 12:
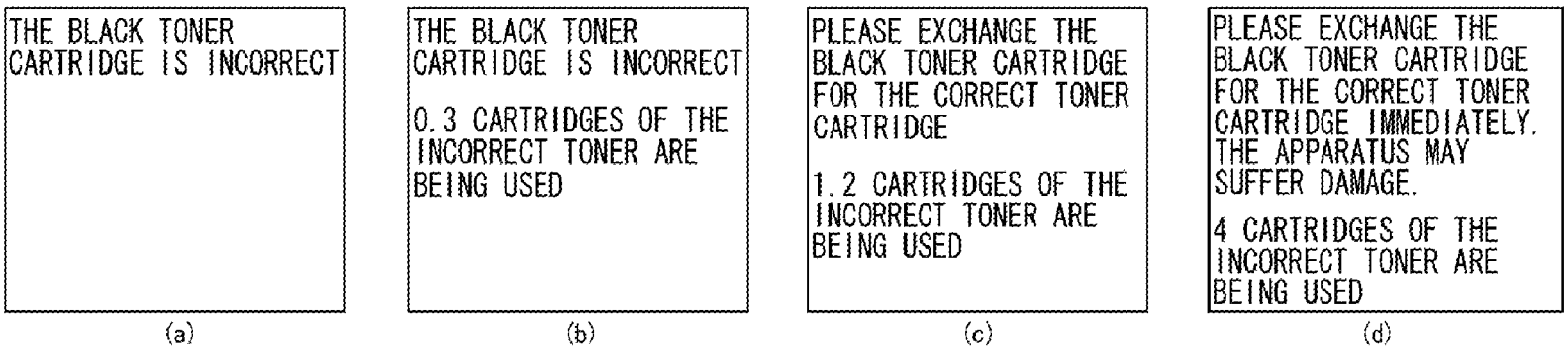
FIG. 12 is a pattern diagram showing an example display of a display unit of the image forming apparatus according to the second embodiment of the present invention.

FIG. 12 is an example display at a time when the display is switched. (a) is a time at which the suitability flag is detected to be "0" but the unsuitable toner has barely (yet) to be used. For example, on the condition that the unsuitable count value is put in terms of the number of toner cartridges, where the number of toner cartridges is set to A=0.1, B=0.5, and C=2, the number less than A is displayed as (a). Next, in a case where the number of toner cartridges is greater than A and less than B, (b) shows the user a display of the actual amount of toner used and information that the used toner is incorrect. In a case where the number of toner cartridges is greater than B and less than C, (c) shows the user a display of the actual amount of toner used and a warning to replace the used toner with the correct toner. In a case where the number of toner cartridges is greater than C, (d) shows the user a display of the actual amount of toner used and a warning that the apparatus may be damaged if the used toner is not replaced with the correct toner. In the manner described above, according to the amount of incorrect toner used, the user can be reminded to refrain from using the unsuitable toner by switching the displayed content to more specific content.

Figure 13:
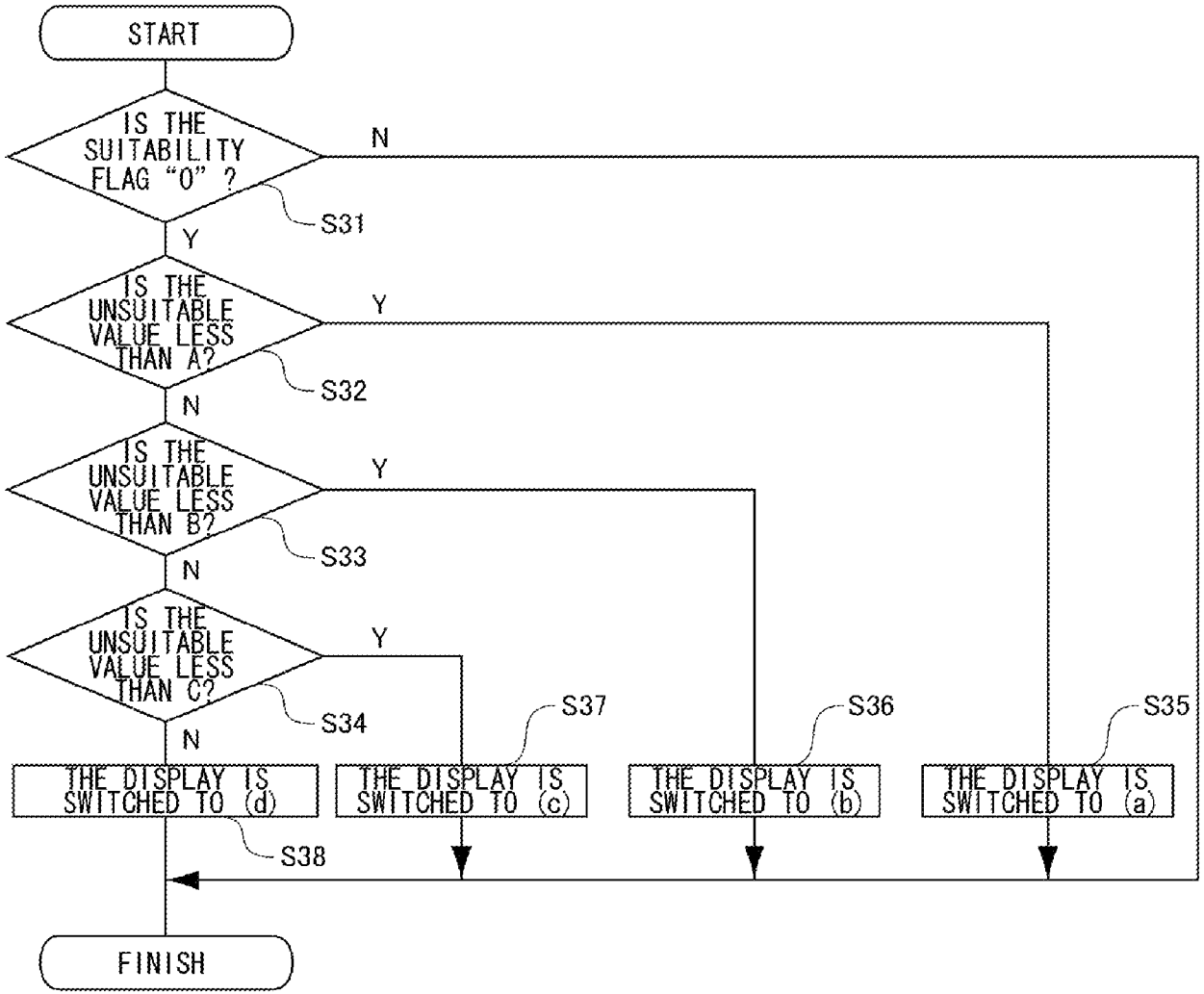
FIG. 13 is a flow chart showing a performance of a display switching unit of the image forming apparatus according to the second embodiment of the present invention.

FIG. 13 is a flow chart showing the performance of the display switching unit. At step S31, the display switching unit makes a judgment as to whether the suitability flag is "0". If the suitability flag is "0", the process moves to step S32. If the suitability flag is "1", the process finishes without any further actions. At step S32, a judgment is made as to whether the unsuitable count value is less than A. If the unsuitable count value is less than A, the process move to step S35. If the unsuitable count value is not less than A, the process move to step S33. At step S35, the display is switched to (a) and the process is finished. At step S33, a judgment is made as to whether the unsuitable count value is less than B. If the unsuitable count value is less than B, the process move to step S36. If the unsuitable count value is not less than B, the process move to step S34. At step S36, the display is switched to (b) and the process is finished. At step S34, a judgment is made as to whether the unsuitable count value is less than C. If the unsuitable count value is less than C, the process move to step S37. If the unsuitable count value is not less than C, the process move to step S38. At step S37, the display is switched to (c) and the process is finished. At step S38, the display is switched to (d) and the process is finished. The display is gradually switched in the manner described above to remind the user to refrain from using the unsuitable toner.

According to the second embodiment described above, the effect can be achieved whereby, according to the amount of incorrect toner used, the user can be reminded to refrain from using the unsuitable toner, such as counterfeit toner, by switching the displayed content to more specific content.

Third Embodiment

Figure 14:
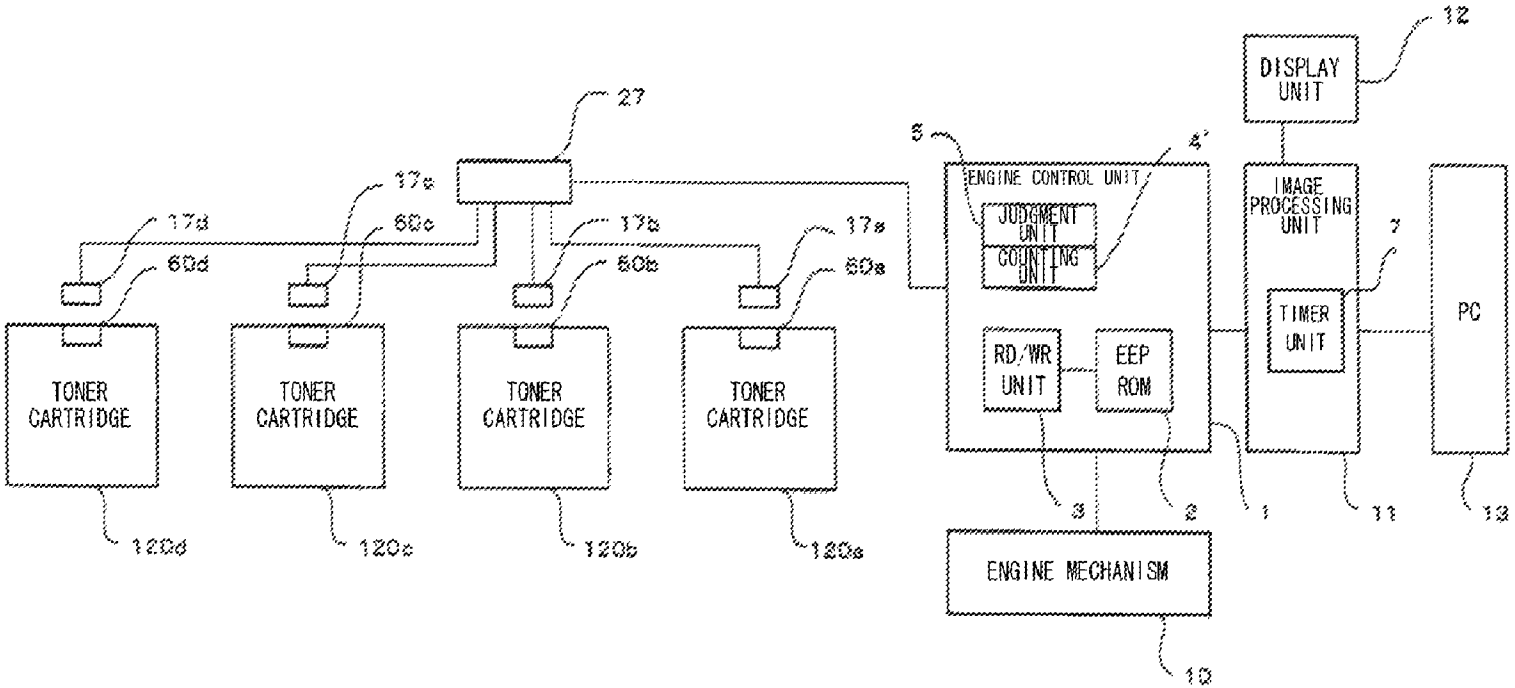
FIG. 14 is a block diagram showing an overall structure of an image forming apparatus according to a third embodiment of the present invention.
Figure 15:
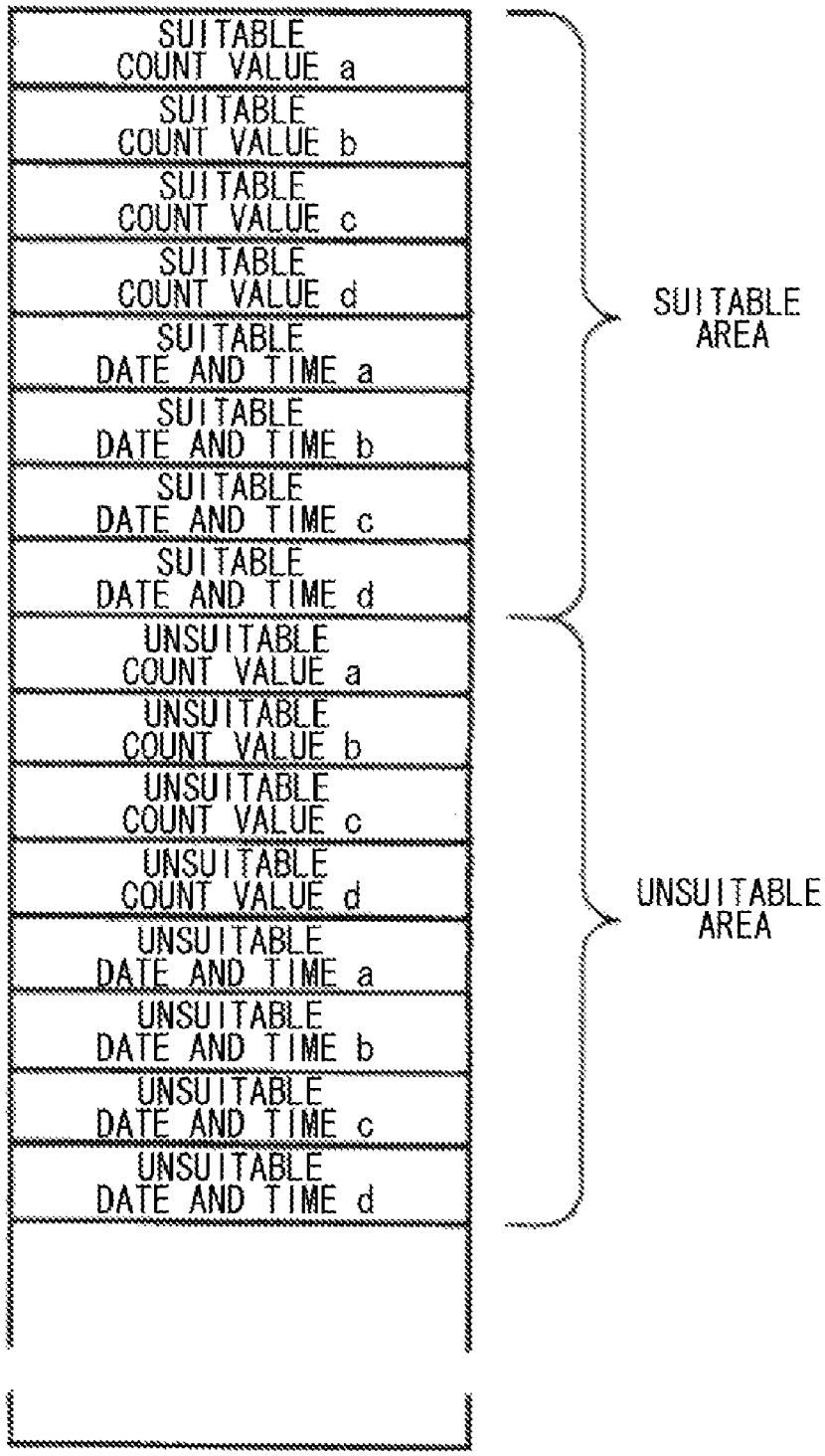
FIG. 15 is a memory map showing one example of data stored in an EEPROM of the image forming apparatus according to the third embodiment of the present invention.
Figure 16:
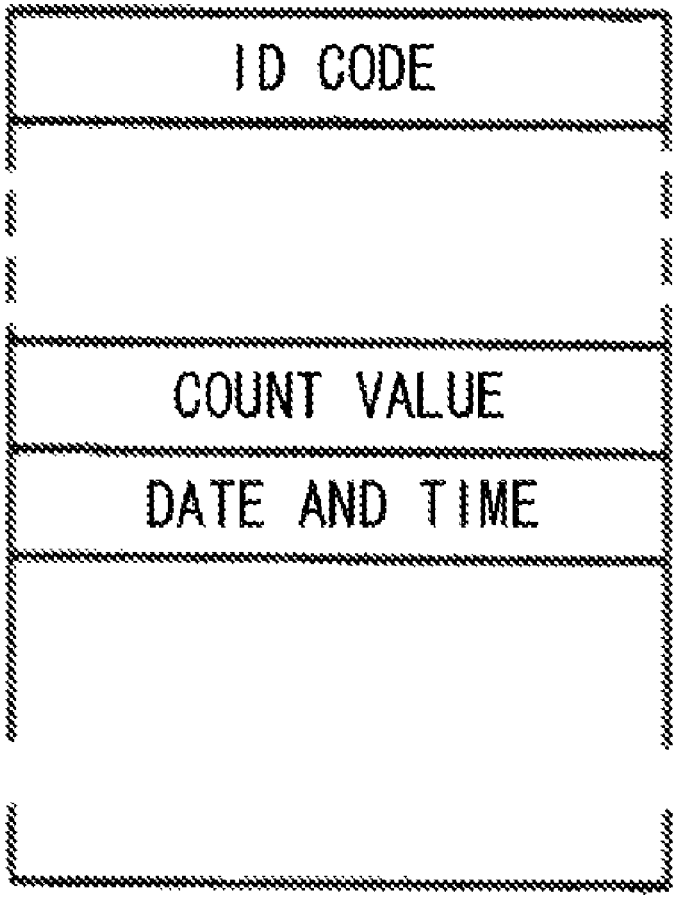
FIG. 16 is a memory map showing one example of data stored in a memory inside a wireless tag of the image forming apparatus according to the third embodiment of the present invention.

FIG. 14 is an overall block diagram of the image forming apparatus of the third embodiment. The difference between the apparatus of FIG. 14 and the color printing apparatus of the first embodiment shown in FIG. 1 is that a timer unit 7 is added to the engine control unit 1. The timing function of the timer unit 7 holds date and time information. The engine control unit 1 inputs the date and time information and writes the date and time information onto the EEPROM at the time when the count value by the counting unit 4 is written onto the EEPROM. FIG. 15 shows one example of data stored in the EEPROM containing the date and time information. In the suitable area and unsuitable area a separate area is preserved for the date and time information for each color, and this area is separate from the suitable area and unsuitable area for the count values. There are two kinds of information as the date and time information, the first is the initial date and time and the second is the updated date and time. The two pieces of date and time information can be stored separately. Because nothing is written in this area at first, the information may be set as ALL "0". If the ALL "0" information is read, the date and time information is written in the area for the initial date and time. If the ALL "0" information is not read, the date and time information is written in the area for the updated date and time. FIG. 16 is one example of the data stored in the memory of the wireless tag, and the area for storing the date and time information is preserved according to FIG. 15. The area for the date and time can be used to store the initial date and time and the updated date and time in the same manner.

Figure 17:
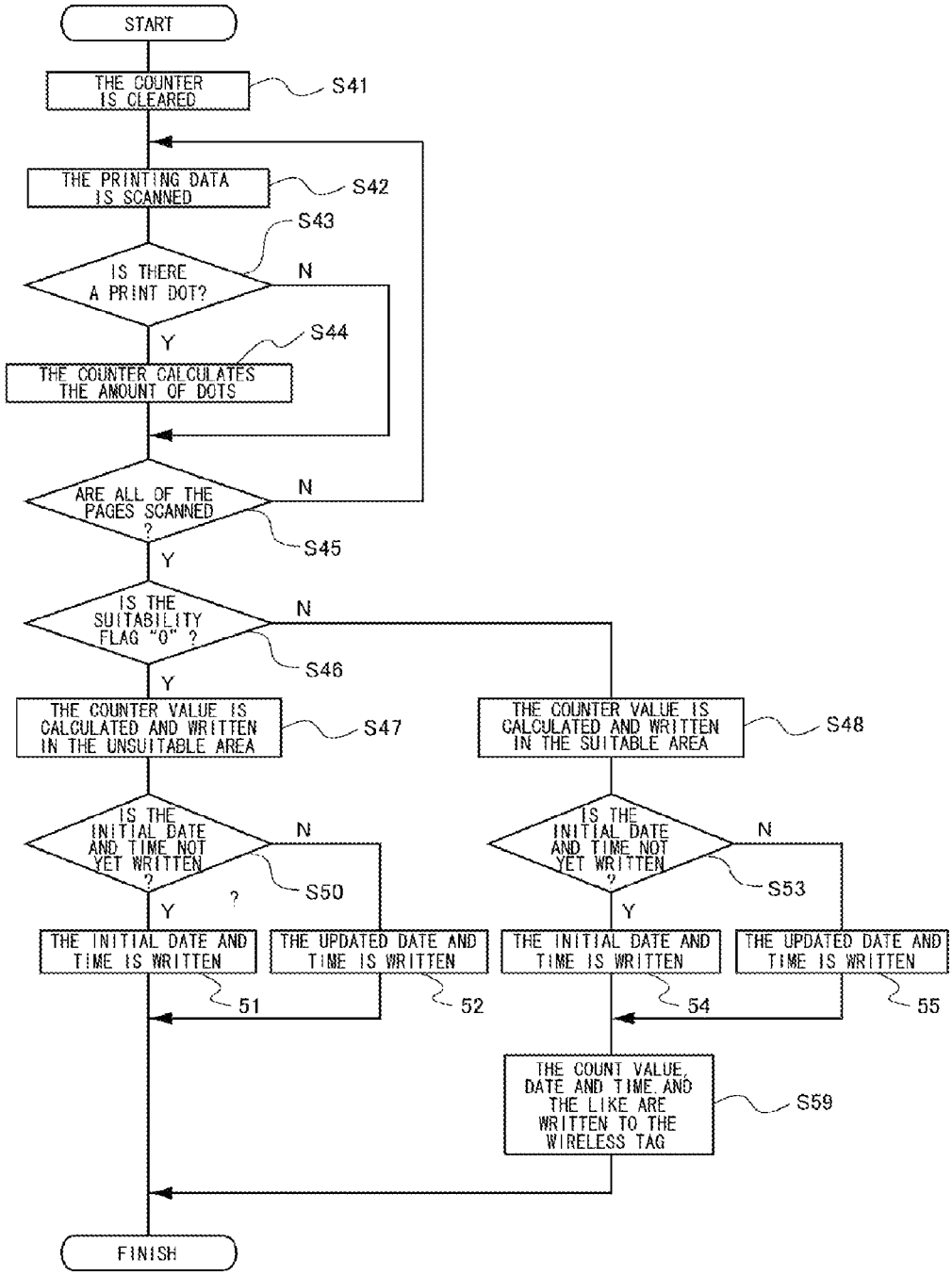
FIG. 17 is a flow chart showing a performance of a counting unit of the image forming apparatus according to the third embodiment of the present invention.

FIG. 17 is a flow chart showing the performance of the counting unit according to the third embodiment. Steps S41 through S46, leading to steps S47 and S48, are the same as steps S11 through S16 of the flow chart of FIG. 8. At step S50, the area for the initial date and time of the Unsuitable Date and Time a in the EEPROM is read and a judgment is made as to whether information has yet to be written in this area. That is, if the information is ALL "0" indicating that writing has not yet been executed, the process moves to step S51. If the information is not ALL "0", the process moves to step S52. At step S51, the initial date and time is written and the process is finished. At step S52, the updated date and time is written and the process is finished. At step S53, the area for the initial date and time of the Suitable Date and Time a in the EEPROM is read and a judgment is made as to whether information has yet to be written in this area. That is, if the information is ALL "0" indicating that writing has not yet been executed, the process moves to step S54. If the information is not ALL "0", the process moves to step S55. At step S54, the initial date and time is written. At step S54, the updated date and time is written. At step S59, the count value, date and time, and the like are written to the wireless tag 60*a* via the reader/writer unit 27. The above is described in terms of 60*a*, but the same process can be executed for 60*b*, 60*c*, 60*d*.

Figure 18:
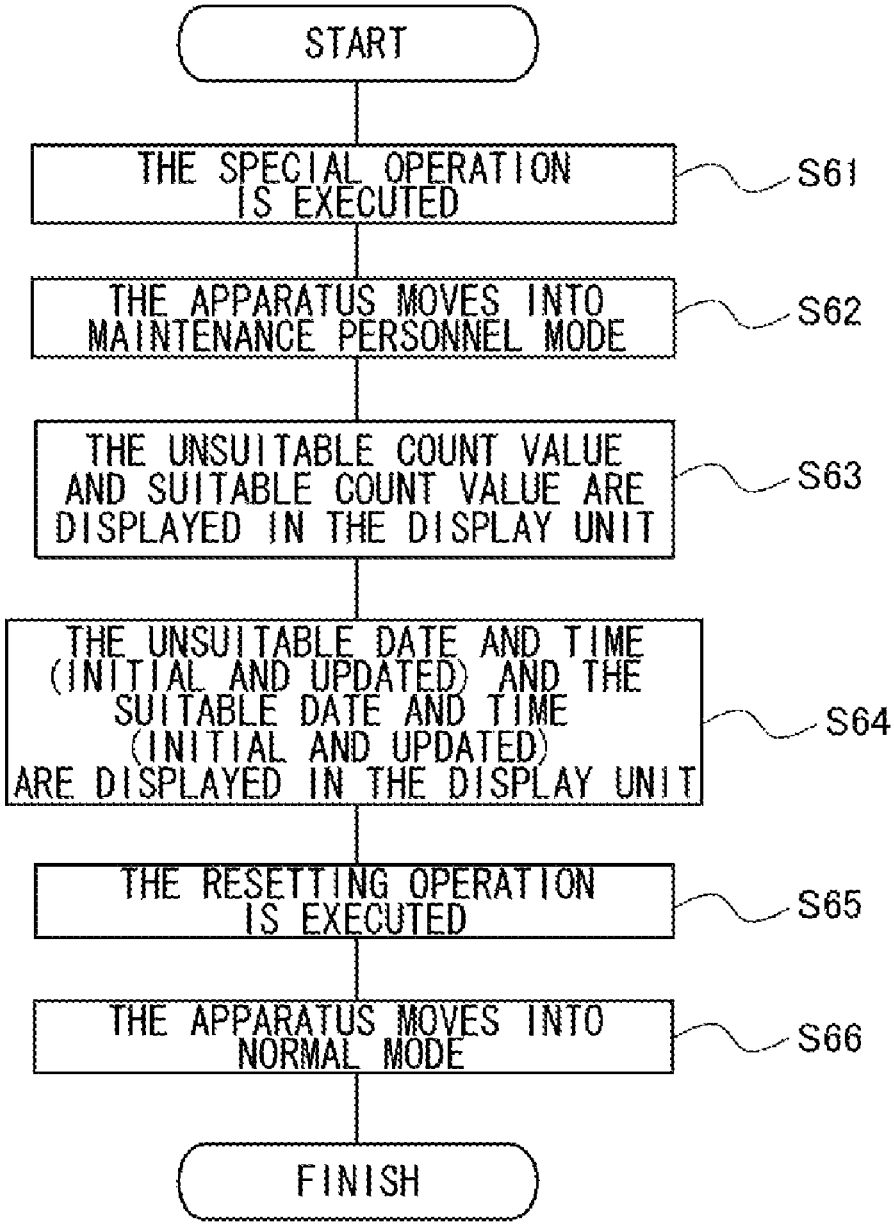
FIG. 18 is a flow chart showing a performance of a display unit of the image forming apparatus according to the third embodiment of the present invention.

FIG. 18 is a flow chart showing the operation of the display unit. In comparison to FIG. 9, FIG. 18 contains the same steps with the additional insertion of step S64 after the step S23 of FIG. 9, resulting in the process of steps S61 to S66. At step S61, the user executes an arbitrary special operation with abnormal use through the display unit, so that the apparatus enters into a maintenance personnel mode (step S62). After the unsuitable count value and suitable count value are displayed in the display unit at step S63, the unsuitable date and time and the suitable date and time are displayed in the display unit as creation the date and time and the updated date and time at step S64 through the operation of an arbitrary key. Next, at step S65, the resetting operation is executed through an arbitrary key operation. At step S64, the unsuitable date and time and the suitable date and time are displayed on the display unit, but may also be printed out in the maintenance personnel mode along with the unsuitable count value and suitable count value.

According to the embodiment described above, in addition to the count values, the information concerning the initial date and time and the updated date and time information be stored in the EEPROM of the main body, and therefore the user can accurately understand the condition of continuous usage of the unsuitable toner cartridge because the maintenance personnel can put the apparatus into maintenance personnel mode using a user address to printout the information or display the information in the display unit. Therefore, the effect is expected that further use of the unsuitable toner cartridge can be restricted.

Fourth Embodiment

Figure 19:
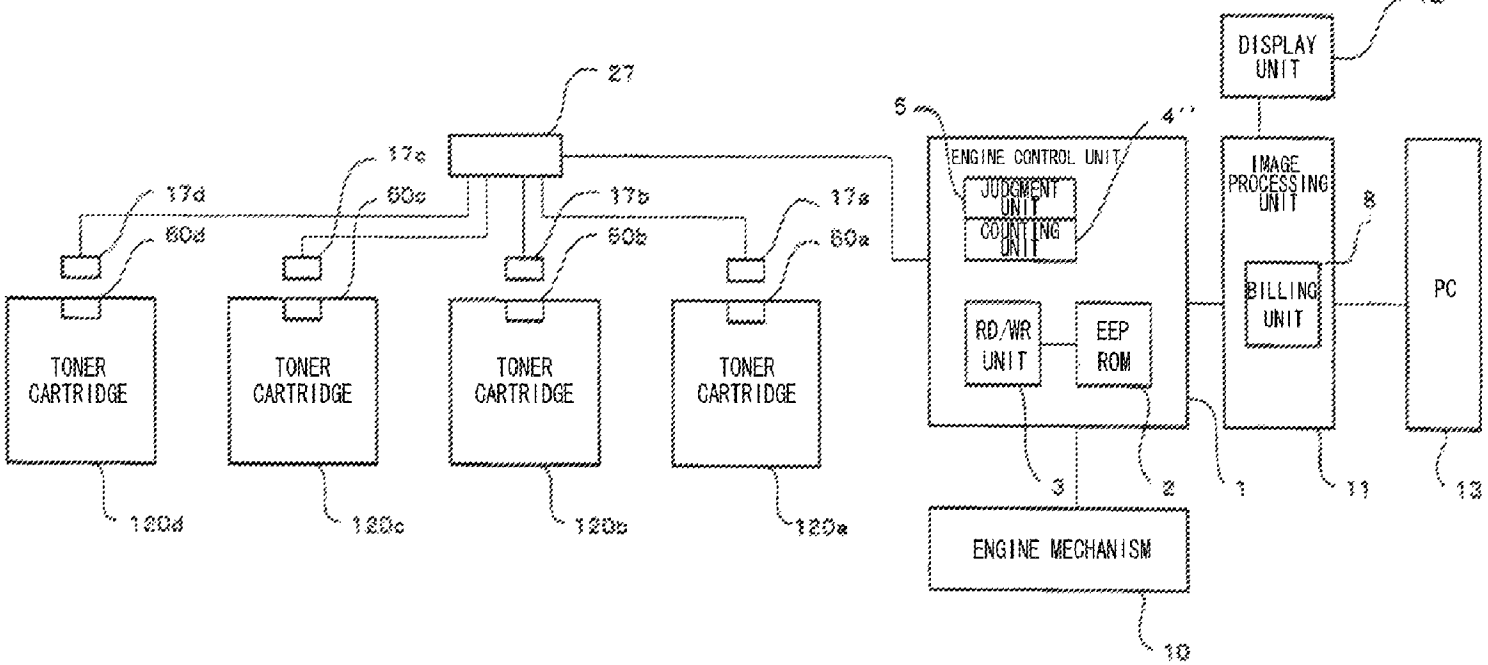
FIG. 19 is a block diagram showing an overall structure of an image forming apparatus according to a fourth embodiment of the present invention.
Figure 20:
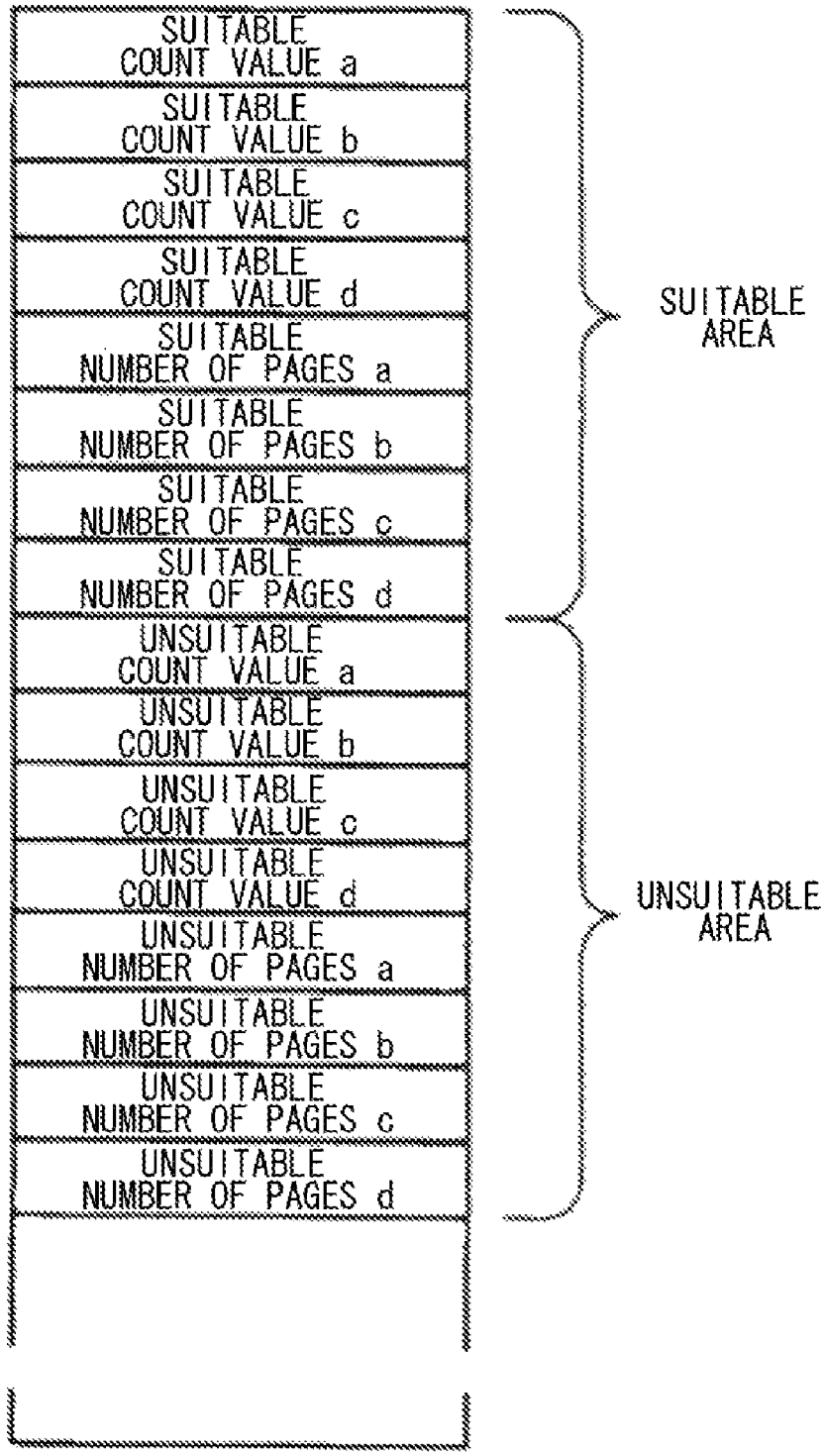
FIG. 20 is a memory map showing one example of data stored in an EEPROM of the image forming apparatus according to the fourth embodiment of the present invention.
Figure 21:
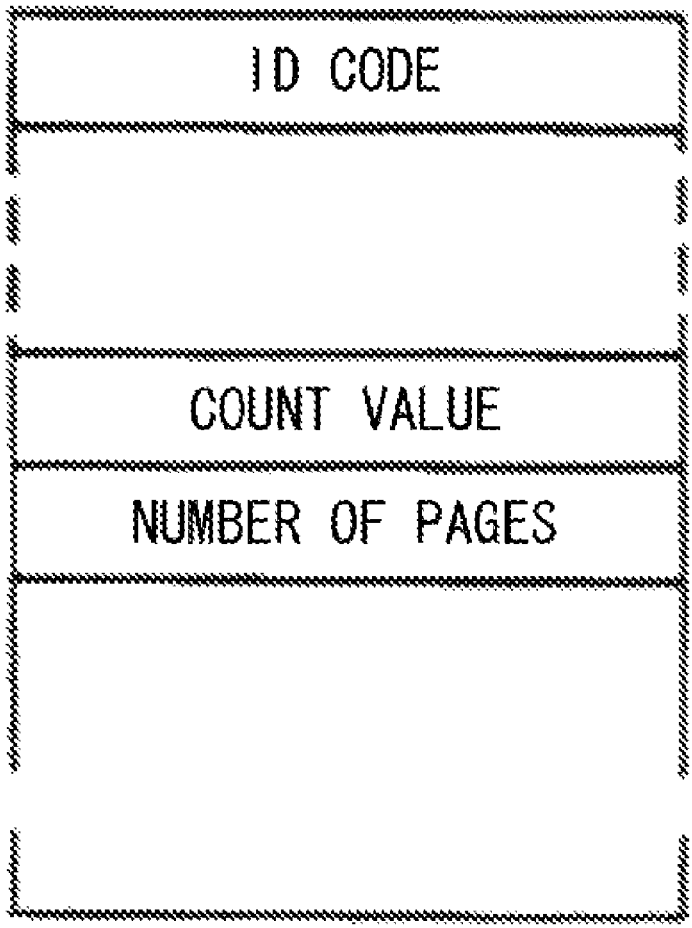
FIG. 21 is a memory map showing one example of data stored in a memory inside a wireless tag of the image forming apparatus according to the fourth embodiment of the present invention.

FIG. 19 is an overall block diagram of the present embodiment. In the present embodiment, a pricing unit 8 having a pricing function is added to the image processing unit 11. The pricing unit 8 executes pricing according to the number of pages used by the user and has a favorable function for pricing according to the number of printed pages in a case where the printing apparatus is a rental, for example. A counting unit 4" counts the number of pages printed in addition to counting the number of unsuitable and suitable dots for all of the pages. FIG. 20 is one example of the data stored in the EEPROM in which the number of pages is added. The data is divided into the suitable and unsuitable areas, in which an area is preserved for the number of pages for every color, in addition to an area for the count values. FIG. 21 is one example of the data stored in the memory of the wireless tag, and shows the area preserved for storing the number of pages corresponding to FIG. 20.

Figure 22:
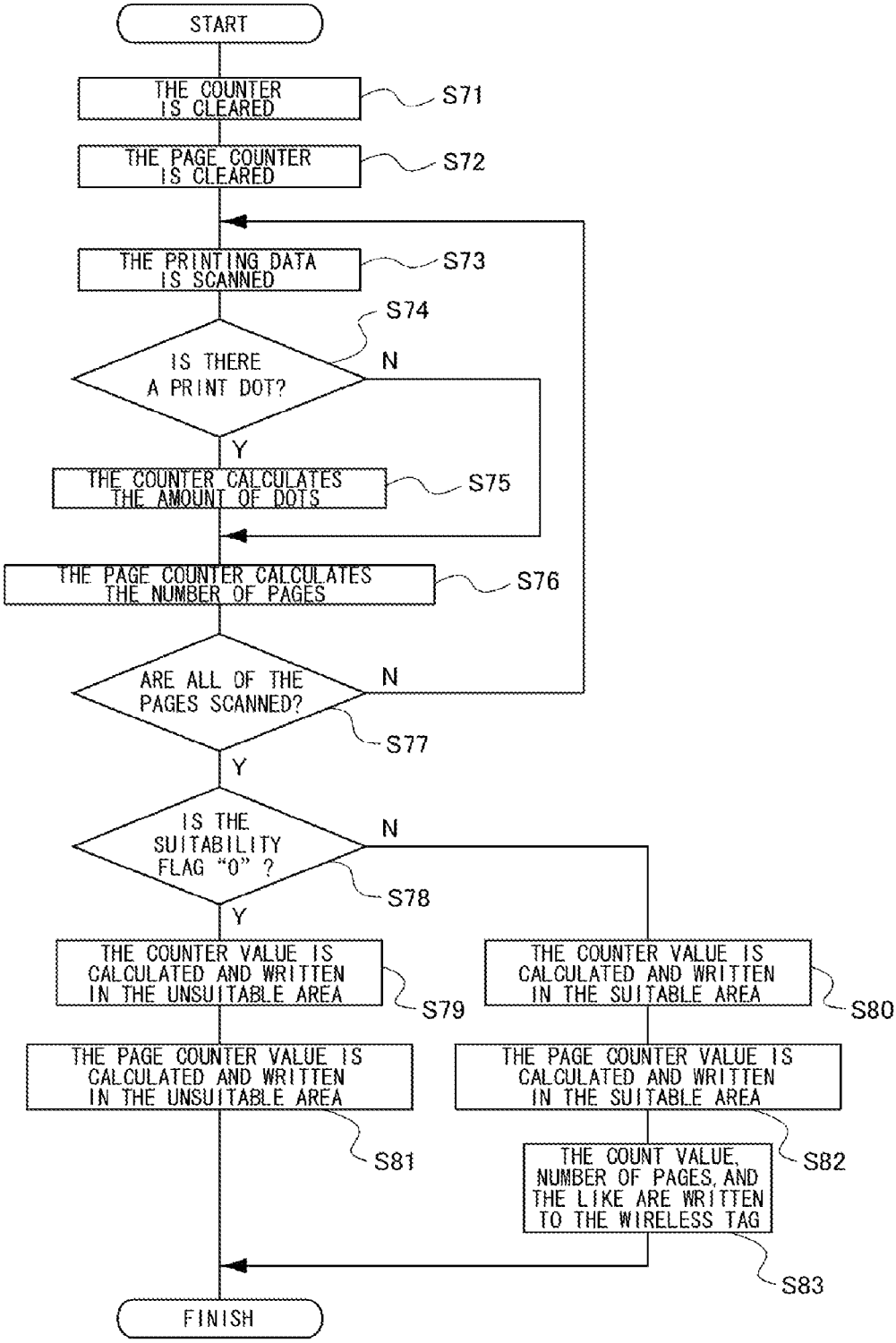
FIG. 22 is a flow chart showing a performance of a counting unit of the image forming apparatus according to the fourth embodiment of the present invention.

FIG. 22 is a flow chart showing the performance of the counting unit of the present embodiment. First, at step S71, the counter inside the counting unit 4" is cleared. At step S72, a page counter inside the counting unit 4" is cleared. At step S73, the printing data is scanned, and a judgment is made at step S74 as to whether there is a printing dot in the scanned area. If there is a printing dot, the process moves to step S75. If there is not a printing dot, the process moves to step S76. At step S75, the amount of dots is added to the counter and the process moves to step S76. At step S76, the number of pages is added to the page counter. At step S77, a judgment is made as to whether all of the pages are scanned. In a case where all of the pages are scanned, the process moves to step S78, and in a case where all of the pages have not been scanned, the process returns to step S73, so that the printing dots of all of the pages and the number of pages are added. At step S78, a judgment is made as to whether the suitability flag described with reference to FIG. 7 is set to "0". If the suitability flag is "0", the process moves to step S79. If the suitability flag is "1", the process moves to step S80. At step S79, the count value is added to the Unsuitable Count Value a in the unsuitable area and written therein. Next, at step S81, the page count value is added to the Unsuitable Number of Pages a in the unsuitable area and written therein, and the process is finished. At step S80, the count value is added to the Suitable Count value a in the suitable area and written therein. Next, at step S82, the page count value is added to the Suitable Number of Pages a in the suitable area and written therein. Next, at step S83, the count value and the number of pages written at steps S80 and S82, respectively, are written to the wireless tag 60*a* via the reader/writer unit 27. The process described above can be performed for the wireless tags 60*b*, 60*c*, 60*d* in the same manner.

Figure 23:
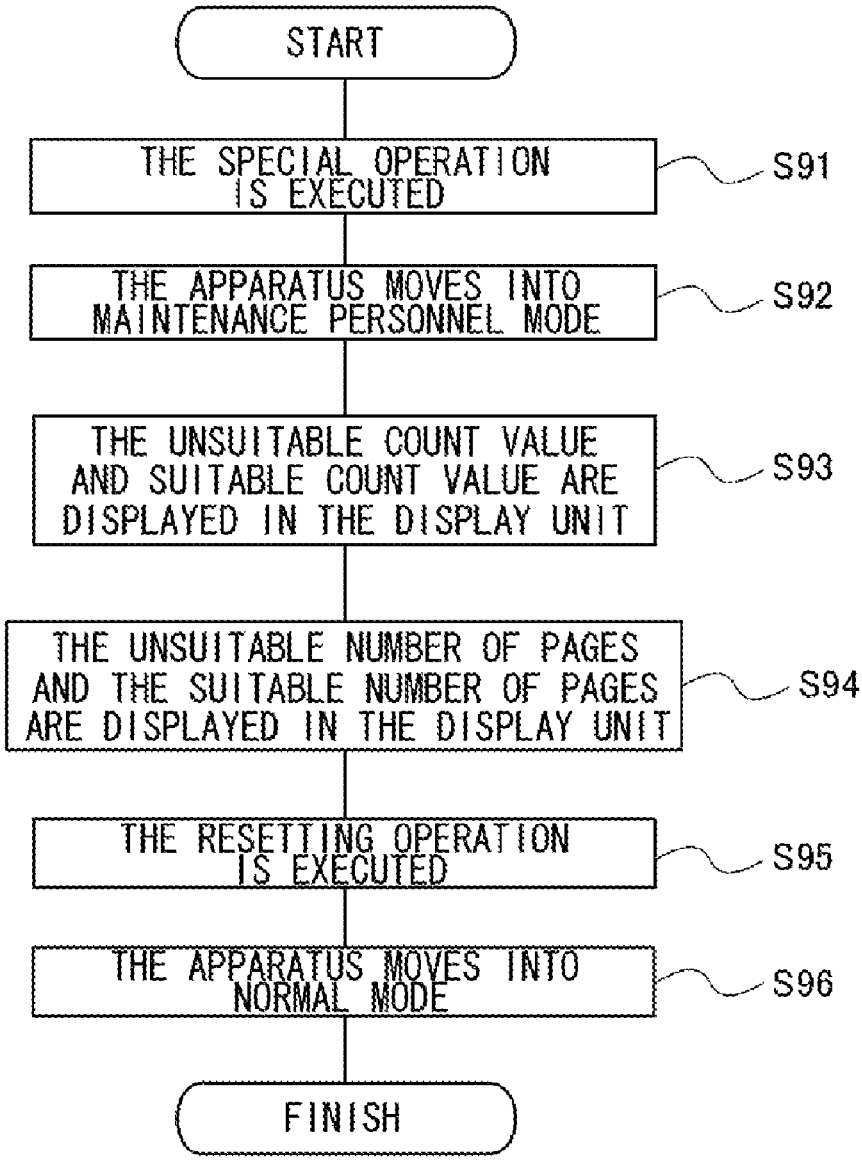
FIG. 23 is a flow chart showing a performance of a display unit of the image forming apparatus according to the fourth embodiment of the present invention.

FIG. 23 is a flow chart showing the operation of the display unit. In comparison to FIG. 9, FIG. 23 contains the same steps with the additional insertion of step S94 after the step S23 of FIG. 9. At step S91, the user executes an arbitrary special operation with abnormal use through the display unit, so that the apparatus enters into a maintenance personnel mode (step S92). After the unsuitable count value and suitable count value are displayed in the display unit at step S93, the unsuitable number of pages and suitable number of pages are displayed in the display unit at step S94 through the operation of an arbitrary key. Next, at step S95, the resetting operation is executed through an arbitrary key operation. At step S96, the unsuitable number of pages and the suitable number of pages are displayed on the display unit, but may also be printed out in the maintenance personnel mode along with the unsuitable count value and suitable count value.

By sending the information concerning the unsuitable and suitable number of pages to the pricing unit 8, the use of unsuitable toner by the user can be restricted because the number of unsuitable pages entails the higher price than the number of suitable pages.

According to the embodiment described above, in addition to the count values, the information concerning the number of pages can be stored in the EEPROM of the main body, and therefore the user can accurately understand the condition of continuous usage of the unsuitable toner cartridge because the maintenance personnel can put the apparatus into maintenance personnel mode using a user address to printout the information or display the information in the display unit. For example, the present embodiment is effective in relation to parts that are affected by the use of the unsuitable toner cartridge over multiple pages, such as a photosensitive drum. Furthermore, the aforementioned information is passed to the pricing function so that it can be expected that further use of the unsuitable toner cartridge can be restricted, because the number of pages using the unsuitable toner entails higher costs than the number of pages using the suitable toner.

The above description uses the toner cartridge as the replaceable part, but the replaceable part may also be an ink tank, ink cartridge, or the like. Furthermore, the continuous use of the unsuitable image drum can be achieved in any manner as long as the wireless tag is housed in an image drum and can make a judgment as to whether the toner drum is unsuitable. By executing the same process, the continuous use of unsuitable parts, such as the fusion device, transfer belt, or the like, can be restricted. The above description uses the RFID as the memory section housed in the toner cartridge, but the judgment concerning suitability or unsuitability may be executed using a barcode reader or a wired EEPROM. However, encoding is necessary so that the ID code for making the judgment concerning suitability or unsuitability cannot be easily imitated. The above description uses the ID code of the RFID as the specific information, but the specific information is not limited to this and may also relate to a serial number, manufacturer's code, or the like.

The above description uses the EEPROM as the memory section of the main body, but any type of memory may be used as long as it is a nonvolatile memory section, such as an SRAM with an attached battery. The above description uses printing or a display in the display unit of the printer as means of notifying the user or maintenance personnel, but the information may also be sent to be displayed by a host PC.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus, comprising:

a replaceable part attachable or removable from a main body;

a primary storage unit attached to said replaceable part for storing specific information concerning said replaceable part;

a reading unit for reading the specific information from said primary storage unit in a condition where said replaceable part is attached;

a control unit that includes a secondary storage unit having a suitable count area and an unsuitable count area and having a judgment unit for making a judgment as to whether said replaceable part is suitable based on the specific information read from said reading unit, said control unit controlling said secondary storage unit to store information concerning use of said replaceable part as a value A in the unsuitable count area of the secondary storage unit after counting said information concerning use of said replaceable part if said judgment unit judges that said replaceable part is unsuitable, said control unit additionally controlling said secondary storage unit to store information concerning use of another replaceable part upon accumulatively adding said information concerning use of said another replaceable part to the value A stored in said unsuitable count area of said secondary storage unit when said another replaceable part is newly attached to said main body if said judgment unit judges that said another replaceable part is unsuitable, said control unit also controlling said secondary storage unit to store information concerning use of said replaceable part as a value B in the suitable count area of said secondary storage after counting said information concerning use of said replaceable part if said judgment unit judges that said replaceable part is suitable, said control unit additionally controlling said secondary storage unit to store information concerning use of said another replaceable part upon accumulatively adding said information concerning use of said another replaceable part to the value B stored in the suitable count area of said secondary storage unit when said another replaceable part is newly attached to said main body if said judgment unit judges that said another replaceable part is suitable; and a notification unit for providing notification based on information concerning use of said replaceable part read from said secondary storage unit.

2. The image forming apparatus according to claim 1, wherein said notification unit changes a content of the notification according to an amount used by said replaceable part in a case where a judgment that said replaceable part is suitable is not made.

3. The image forming apparatus according to claim 1, wherein the information concerning use stored in said secondary storage unit includes at least one of a dot count, date and time information, and a number of pages printed.

4. The image forming apparatus according to claim 1, wherein date and time information regarding date and time of use of said replaceable part are additionally stored in said secondary storage unit.

5. The image forming apparatus according to claim 1, wherein said replaceable part is a toner cartridge or an inkjet cartridge.

6. The image forming apparatus according to claim 1, wherein said primary storage unit is an RFID tag.

7. The image forming apparatus according to claim 1, wherein said notification unit is a display unit equipped on said main body of the apparatus.

8. The image forming apparatus according to claim 1, wherein said notification unit provides notification concerning image formation executed by said main body of the apparatus.

9. The image forming apparatus according to claim 1, wherein a maintenance personnel mode is entered into according to a special operation so that, while in the maintenance personnel mode, the data relating to suitability or unsuitability is displayed in a display screen or printed out.

10. The image forming apparatus according to claim 1, wherein said replaceable part contains any one of a photosensitive drum, a fusion device, or a transfer belt.

11. The image forming apparatus according to claim 1, wherein said primary storage area is a wired EEPROM.

12. The image forming apparatus according to claim 1, wherein said controlling unit also controls said primary storage unit to store information concerning use of said replaceable part after counting said information concerning use of said replaceable part if said judgment unit judges that said replaceable part is suitable, and to store information concerning use of a further replaceable part upon adding said information concerning use of said further replaceable part to a value stored in said primary storage area when said further replaceable part is newly added if said judgment unit judges that said further replaceable part is suitable.

13. The image forming apparatus according to claim 1, further comprising a pricing unit having a pricing function for charging more for printed pages if said judging unit judges said replaceable part to be unsuitable than if said judging unit judges it to be suitable.

14. The image forming apparatus according to claim 1, wherein said replaceable part is a replaceable part for a predetermined color, and further comprising at least one additional replaceable part for at least one additional color, and wherein said control unit controls said secondary storage unit to store information concerning use of said replaceable parts as suitable values or unsuitable values in different areas of said secondary storage unit for each color.

15. The image forming apparatus according to claim 1, wherein said image forming apparatus forms images on pages using toner, wherein said replaceable part is a replaceable part for a predetermined color, and further comprising at least one additional replacement part for at least one additional color, and wherein said control unit controls said secondary storage unit to store the number of pages as suitable values or unsuitable values according to the consumed amount of toner in different areas of said secondary storage unit for each color.

16. A method for distinguishing a suitable part, comprising the steps of:

equipping on a portion of a replaceable part attachable and detachable from a main body of an apparatus, a primary storage unit for storing specific information concerning said replaceable part;

reading the specific information from said primary storage unit in a condition where said replaceable part is equipped;

storing information concerning a number of times that said replaceable part has been used as a value A in an unsuitable count storage area of a secondary storage unit in a case where a judgment is made that said replaceable part is unsuitable as a result of a judgment as to whether said replaceable part is suitable based on the read specific information, and additionally accumulatively adding information concerning a number of times that an additional replaceable part has been used to the value A stored in the unsuitable count area of the secondary storage unit in a case where a judgment is made that the another replaceable part is unsuitable;

storing information concerning a number of times that said replaceable part has been used as a value B in a suitable count storage area of the secondary storage unit in a case where a judgment is made that said replaceable part is suitable as a result of the judgment as to whether said replaceable part is suitable based on the read specific information, and additionally accumulatively adding information concerning a number of times that said additional replaceable part has been used to the value B stored in the suitable count area of the secondary storage unit in a case where a judgment is made that said additional replaceable part is suitable;

reading the information concerning the usage of said replaceable part from said suitable count area and said unsuitable count area of said secondary storage unit; and providing notification based on the information concerning usage.

* * * * *